US008690615B2

(12) United States Patent
Sullivan-Malervy et al.

(10) Patent No.: US 8,690,615 B2
(45) Date of Patent: Apr. 8, 2014

(54) CAPACITOR

(75) Inventors: Mary Elizabeth Sullivan-Malervy, Downingtown, PA (US); Jessica Henderson Brown-Hemond, Mifflintown, PA (US); Robert Daniel Hilty, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 146 days.

(21) Appl. No.: 13/287,908

(22) Filed: Nov. 2, 2011

(65) Prior Publication Data

US 2013/0109234 A1 May 2, 2013

(51) Int. Cl.
*H01R 9/24* (2006.01)

(52) U.S. Cl.
USPC ..... 439/886; 361/311

(58) Field of Classification Search
USPC ..... 439/886, 66, 607.1, 620.09, 607.06, 439/607.11, 620.01, 18, 887; 174/254, 255, 174/260, 261, 262; 29/874; 361/313, 311
See application file for complete search history.

(56) References Cited

U.S. PATENT DOCUMENTS

| | | | | |
|---|---|---|---|---|
| 4,827,323 | A * | 5/1989 | Tigelaar et al. | 257/534 |
| 4,906,209 | A | 3/1990 | Tanabe et al. | |
| 5,887,324 | A * | 3/1999 | Wu | 29/25.42 |
| 7,125,767 | B2 * | 10/2006 | Jeong et al. | 438/253 |
| 2005/0162177 | A1 | 7/2005 | Chou | |
| 2008/0010798 | A1 | 1/2008 | Borland et al. | |
| 2010/0311289 | A1 | 12/2010 | Sullivan et al. | |
| 2010/0330851 | A1 * | 12/2010 | Costello | 439/884 |

FOREIGN PATENT DOCUMENTS

| | | |
|---|---|---|
| EP | 0932221 A2 | 7/1999 |
| GB | 1564576 A | 4/1980 |

OTHER PUBLICATIONS

International Search Report, International Application No. PCT/US2012/060199, International Filing Date Oct. 15, 2012.

* cited by examiner

*Primary Examiner* — Renee Luebke
*Assistant Examiner* — Harshad Patel

(57) ABSTRACT

An electrical contact includes a body having a mating segment. At least a portion of the mating segment defines a first conductive element having a three-dimensional (3D) surface. A dielectric layer is formed directly on the 3D surface of the first conductive element in engagement with the 3D surface. A second conductive element is formed on the dielectric layer such that the dielectric layer extends between the first and second conductive elements. The first and second conductive elements and the dielectric layer form a capacitor.

13 Claims, 8 Drawing Sheets

CAPACITOR

BACKGROUND OF THE INVENTION

The subject matter described and/or illustrated herein relates generally to capacitors.

Competition and market demands have continued the trend toward smaller and higher performance (e.g., faster) electronic systems. As a result, electrical connectors are being designed to transmit signals at higher frequencies and/or at lower voltages. To improve signal quality in such electrical connectors, capacitors are sometimes coupled within signal paths that are within or adjacent the electrical connectors.

For example, some known electrical connectors are mounted on a circuit board. Capacitors may be mounted on the circuit board adjacent the electrical connector and within signal paths of the circuit board that extend from and to the electrical connector. But, only a limited amount of space is available on the circuit board on which the electrical connector is mounted. For example, due to the increased demand for smaller electronic packages and higher signal speeds, circuit boards may not have room for capacitors. Moreover, adding capacitors within the signal paths of the circuit board may negatively impact the electrical performance of the circuit board. For example, the capacitors may necessitate a less than optimal relative arrangement of the various signal paths along the circuit board, which may add noise and/or reduce signal speeds along the signal paths. Moreover, parasitic inductance, capacitance, resistance, and/or the like of capacitors may negatively impact the electrical performance of the circuit board.

Other known higher-speed electrical connectors include separate, discrete capacitors that are held within the electrical connector and coupled within signal paths of the electrical connector, for example using solder. But, providing such discrete capacitors within the signal paths of an electrical connector may make it difficult to match the electrical impedance of the signal paths of the electrical connector with the impedance through the capacitors and/or through a circuit board on which the electrical connector is mounted. Moreover, solder may introduce reliability concerns as the joints between the solder and the signal paths of the electrical connector may be brittle and/or easy to break.

BRIEF DESCRIPTION OF THE INVENTION

In one embodiment, an electrical contact includes a body having a mating segment. At least a portion of the mating segment defines a first conductive element having a three-dimensional (3D) surface. A dielectric layer is formed directly on the 3D surface of the first conductive element in engagement with the 3D surface. A second conductive element is formed on the dielectric layer such that the dielectric layer extends between the first and second conductive elements. The first and second conductive elements and the dielectric layer form a capacitor.

In another embodiment, a capacitor includes a first conductive element, a second conductive element, and a dielectric layer extending between the first and second conductive elements. The dielectric layer includes first and second sub-layers. The first sub-layer includes a different dielectric material than the second sub-layer.

In another embodiment, an electrical contact includes a body having a mating segment. The mating segment includes a three-dimensional (3D) surface. A capacitor extends on the mating segment of the body. The capacitor includes first and second conductive elements separated by a dielectric layer.

The first conductive element is formed directly on the 3D surface of the mating segment in engagement with the 3D surface.

DETAILED DESCRIPTION OF THE INVENTION

Figure 1:
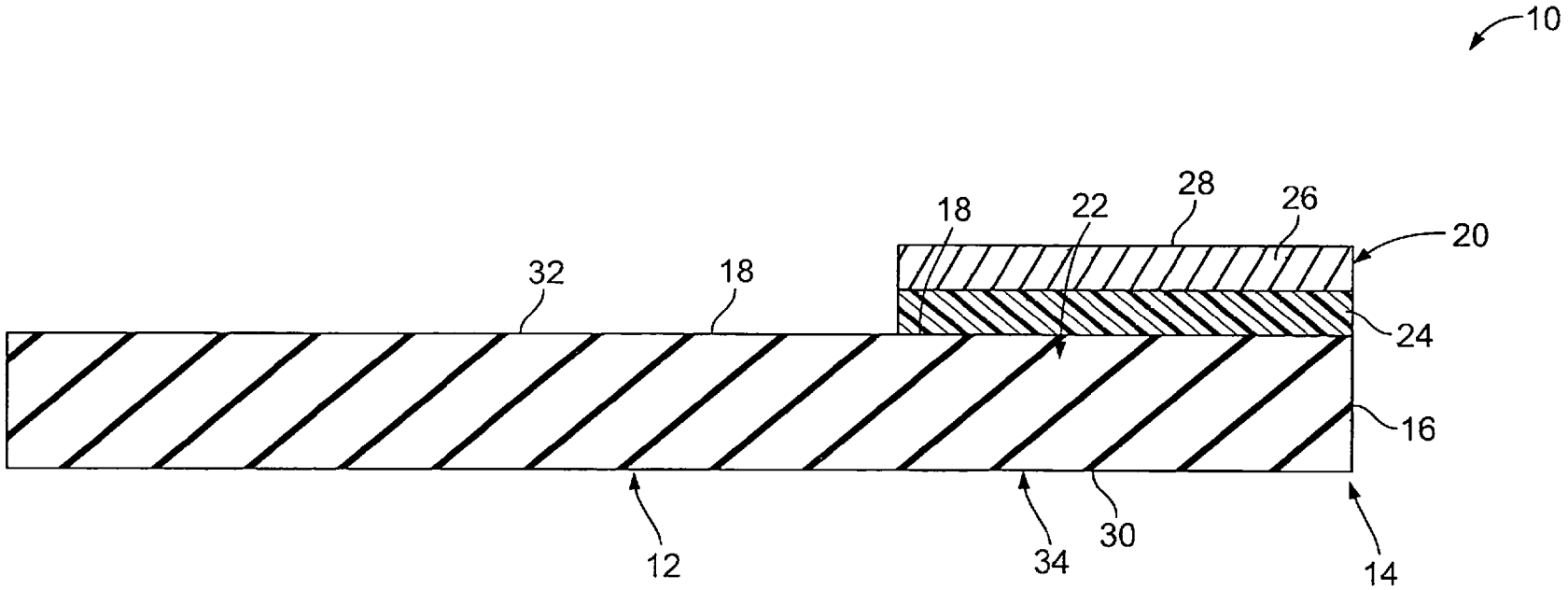
FIG. 1 is a cross-sectional view of an exemplary embodiment of an electrical contact.

FIG. 1 is a cross-sectional view of an exemplary embodiment of an electrical contact 10. The electrical contact 10 includes a segment 12 that extends to a tip, or end, 14. The tip 14 includes a tip surface 16. Optionally, the segment 12 is a mating segment that is configured to mate with any electrical device, such as, but not limited to, one or more other electrical contacts (not shown; such other electrical contacts may each be referred to herein as a "mating contact"), an electrical via (not shown) of a circuit board (not shown) or other electrical device (not shown), an electrical conductor (not shown) of an electrical cable (not shown), an electrical power source (not shown), any other type of electrical device (not shown), and/or the like.

The segment 12 optionally includes a three-dimensional (3D) surface 18. The 3D surface 18 is non-planar. The 3D shape of the 3D surface 18 may be defined by one or more 3D (e.g., rounded) sub-surfaces, by two or more two dimensional (2D) sub-surfaces that are angled non-parallel to each other, or by a combination thereof. The segment 12 may additionally or alternatively include any other shape than shown herein. Any amount, portion(s), sub-segment(s), location(s) thereon, and/or the like of the segment 12 may include the 3D surface 18.

The electrical contact 10 includes an exemplary embodiment of a capacitor 20. The capacitor 20 optionally extends on the 3D surface 18 of the segment 12. Alternatively, the capacitor 20 extends only on a 2D surface of the segment 12. The capacitor 20 includes a conductive element 22, a dielectric layer 24, and a conductive element 26. The conductive element 22 is optionally defined by the segment 12 of the electrical contact 10. More specifically, the conductive element 22 is optionally defined by the portions of the segment 12 over which the remainder (e.g., the dielectric layer 24 and the conductive element 26) of the capacitor 20 extend. Accordingly, and optionally, the conductive element 22 includes at least a portion of the 3D surface 18. In some alternative embodiments, the conductive element 22 is not defined by the segment 12 of the electrical contact, but rather is a discrete conductive layer that extends on the segment 12 between the dielectric layer 24 and the segment 12. The conductive element 22 may be referred to herein as a "first" conductive element. The conductive element 26 may be referred to herein as a "second" conductive element.

The dielectric layer 24 is formed directly on the 3D surface 18 of the conductive element 22 in engagement with the 3D surface 18. The conductive element 26 is formed on the dielectric layer 24. In the exemplary embodiment, the conductive element 26 is formed directly on the dielectric layer 24 in engagement therewith. The dielectric layer 24 extends between the conductive elements 22 and 26 such that the dielectric layer 24 separates, or spaces apart, the conductive elements 22 and 26 by a gap G. The dielectric layer 24 and the conductive elements 22 and 26 thereby form a capacitive structure. Optionally, capacitor 20 includes another dielectric layer (not shown) formed on the conductive element 26, and another conductive element (not shown) formed on the other dielectric layer that is formed on the conductive element 26.

Various parameters of the capacitor 20 may be selected to provide the capacitor 20 with a predetermined capacitance. Examples of parameters of the capacitor 20 that may be selected to provide the predetermined capacitance include, but are not limited to, the materials used to fabricate the dielectric layer 24 and the conductive elements 22 and 26, electrical conductivity of the conductive elements 22 and 26, a dielectric constant of the dielectric layer 24, the distance between the conductive elements 22 and 26 (e.g., the amount of the gap G), the thickness of the conductive elements 22 and 26, the surface area of the conductive elements 22 and 26, an area of the amount the conductive elements 22 and 26 overlap each other, and/or the like.

Optionally, the conductive element 26 includes a mating interface 28 at which the segment 12 engages, and thereby establishes an electrical connection with, an electrical device. In addition or alternatively, the segment 12 engages the electrical device at other mating interfaces (e.g., mating interfaces 30 and/or 32). In addition or alternatively to the location of the capacitor 20 shown herein, the capacitor 20 may extend at any other location(s) along the segment 12. For example, the dielectric layer 24 and the conductive element 26 may extend at any other location(s) along the segment 12 in addition or alternative to the location shown herein. In some embodiments, the dielectric layer 24 and/or the conductive element 26 extend over the tip surface 16 and/or over a side 34 of the segment 12.

The dielectric layer 24 may include a single sub-layer of dielectric material, a plurality of sub-layers of completely the same dielectric material, a plurality of sub-layers of different dielectric materials, or a combination of a plurality of sub-layers of completely the same dielectric material and a plurality sub-layers of different dielectric materials. In the exemplary embodiment, the dielectric layer 24 includes a single sub-layer of dielectric material. The dielectric layer 24 may include any number of sub-layers. The term "different dielectric material" means that at least one of the sub-layers of the dielectric layer 24 includes at least one different dielectric material component than at least one other sub-layer of the dielectric layer 24. In some embodiments, at least one of the sub-layers of the dielectric layer 24 is fabricated from a completely different (does not share any dielectric material components) dielectric material than at least one other sub-layer of the dielectric layer 24. The sub-layers of the dielectric layer 24 may have any relative arrangement within the dielectric layer 24. For example, in some embodiments, the dielectric layer 24 includes alternating sub-layers of different dielectric materials.

Figure 2:
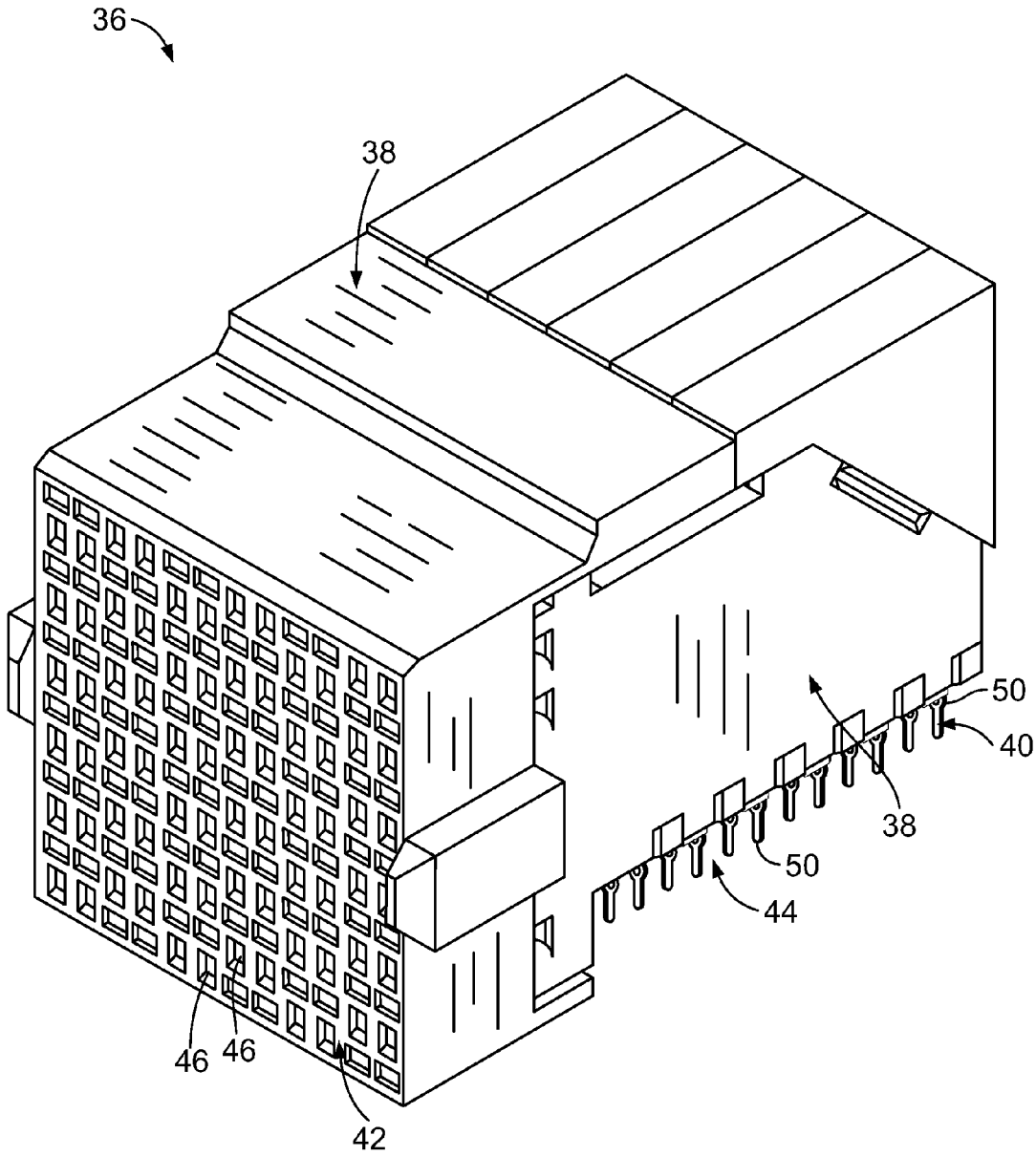
FIG. 2 is a perspective view of an exemplary embodiment of an electrical connector.

FIG. 2 is a perspective view of an exemplary embodiment of an electrical connector 36. The electrical connector 36 includes a housing 38 that holds a plurality of electrical contacts 40. The housing 38 includes a mating ends 42 and 44. A plurality of ports 46 extend through the mating end 42 for exposing mating segments 48 (FIG. 11) of the electrical contacts 40. The electrical contacts 40 also include mating segments 50 that extend along the mating end 44. In the exemplary embodiment, the mating segments 50 of the electrical contacts 40 are eye-of-the-needle (EON) pins. The electrical contacts 40 provide conductive paths for the electrical connector 36 to convey electric voltage and/or current. Each electrical contact 40 may be a signal contact that communicates electrical data signals, a ground contact, or a power contact that transmits electrical power to, from, and/or through the electrical connector 26. The electrical connector 36 may include any number of the electrical contacts 40. Moreover, although described herein as being mating segments 48 and 50 of the same electrical contact 40, in some alternative embodiments, corresponding mating segments 48 and 50 are electrically connected together via an intervening electrical member, such as, but not limited to, a lead, a trace, another other structure, and/or the like.

The electrical connector 36 is used to illustrate merely one example of a wide variety of devices that may incorporate one or more embodiments of the subject matter described and/or illustrated herein. The electrical contacts having capacitors described and/or illustrated herein are not limited to being used with the electrical connector 36, but rather may be used with any other type of electrical connector (having any geometry, configuration, and/or the like) and/or any other type of electrical device.

Figure 3:
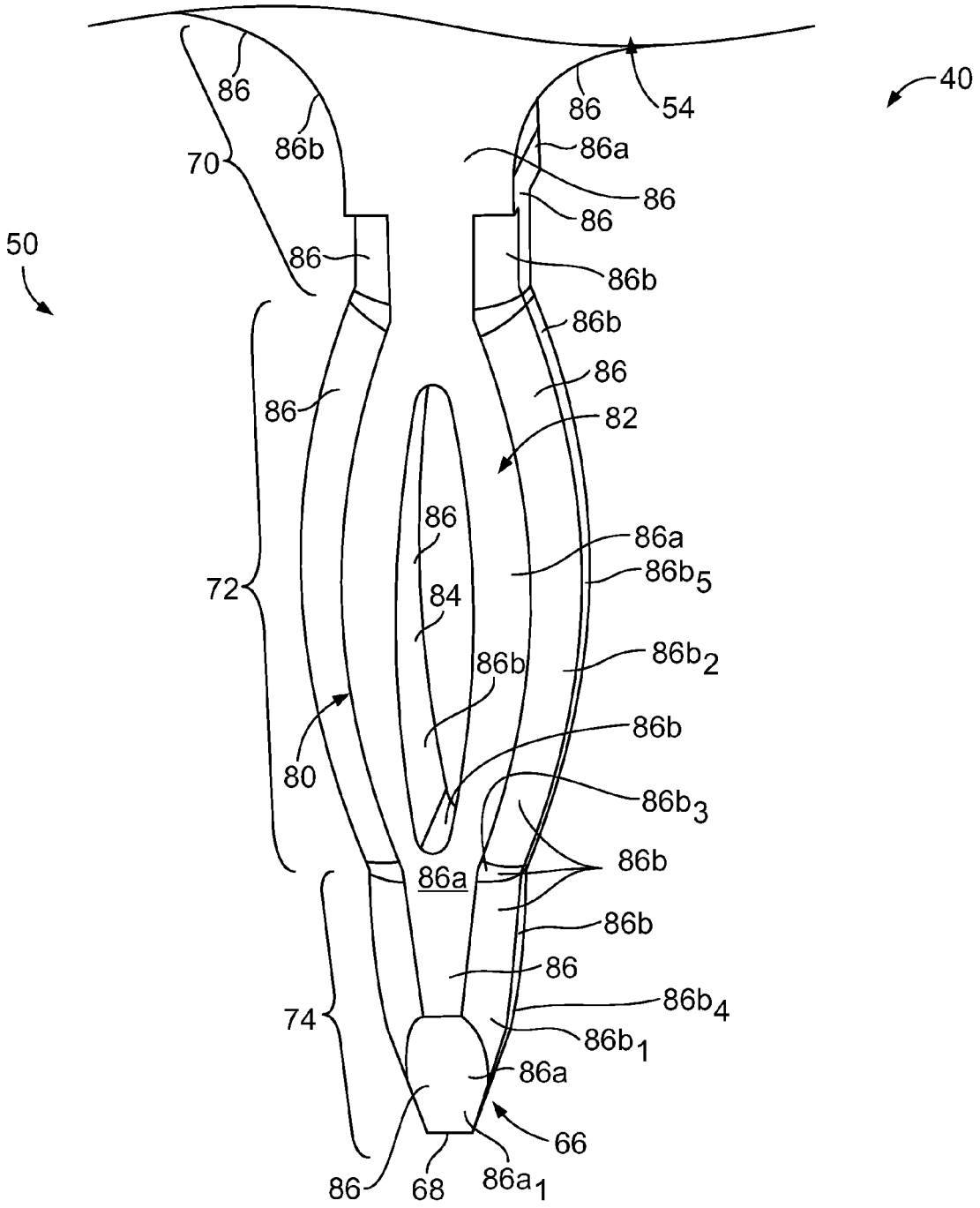
FIG. 3 is a perspective view of a portion of an exemplary embodiment of an electrical contact of the electrical connector shown in FIG. 2 illustrating an exemplary embodiment of a mating segment of the electrical contact.

FIG. 3 is a perspective view of a portion of one of the electrical contacts 40 illustrating an exemplary embodiment of the mating segment 50. The mating segment 50 extends a length outwardly from a base 54 to a tip 66 having a tip surface 68. The mating segment 50 includes a neck sub-segment 70, a compliant sub-segment 72, and a tip sub-segment 74. The neck sub-segment 70 extends outwardly from the base 54. The compliant sub-segment 72 extends outwardly from the neck sub-segment 70, and the tip sub-segment 74 extends outwardly from the compliant sub-segment 72. The compliant sub-segment 72 extends from the neck sub-segment 70 to the tip sub-segment 74. The tip sub-segment 74 includes the tip 66.

The compliant sub-segment 72 includes two opposing arms 80 and 82. The arms 80 and 82 are spaced apart to define an opening 84 therebetween. As can be seen in FIG. 3, the mating segment 50 includes a 3D surface 86. The 3D surface 86 is non-planar. The 3D surface 86 includes the tip surface 68, which is a sub-surface of the 3D surface 86. In the exemplary embodiment, the 3D surface 86 of the mating segment 50 includes a plurality of two-dimensional (2D) sub-surfaces **86*a*. At least some adjoining 2D sub-surfaces 86*a* are angled non-parallel to each other, which gives the exemplary embodiment of the surface 86 a portion of the 3D shape of the surface 86. In other words, when considered together, adjoining 2D sub-surfaces 86*a* that are angled non-parallel to each other have a 3D shape. In the exemplary embodiment, other portions of the 3D shape of the 3D surface 86 are provided by 3D sub-surfaces 86*b* of the 3D surface 86 that are rounded. In some alternative embodiments, the 3D shape of the 3D surface 86 is entirely defined by one or more 3D sub-surfaces, or is entirely defined by two or more 2D sub-surfaces that are angled non-parallel to each other. In addition or alternative to the shape of the mating segment 50 shown and described herein, any other portions of the mating segment 50 may include a 3D shape. Moreover, more or less of the surface area of the surface 86 of the mating segment 50 may have a 3D shape. Only some of the sub-surfaces 86***a* and 86*b* are visible in FIG. 3. Moreover, only some of the visible surface 86 and only some of the visible sub-surfaces 86*a* and 86*b* may be labeled in FIG. 3.

Figure 4:
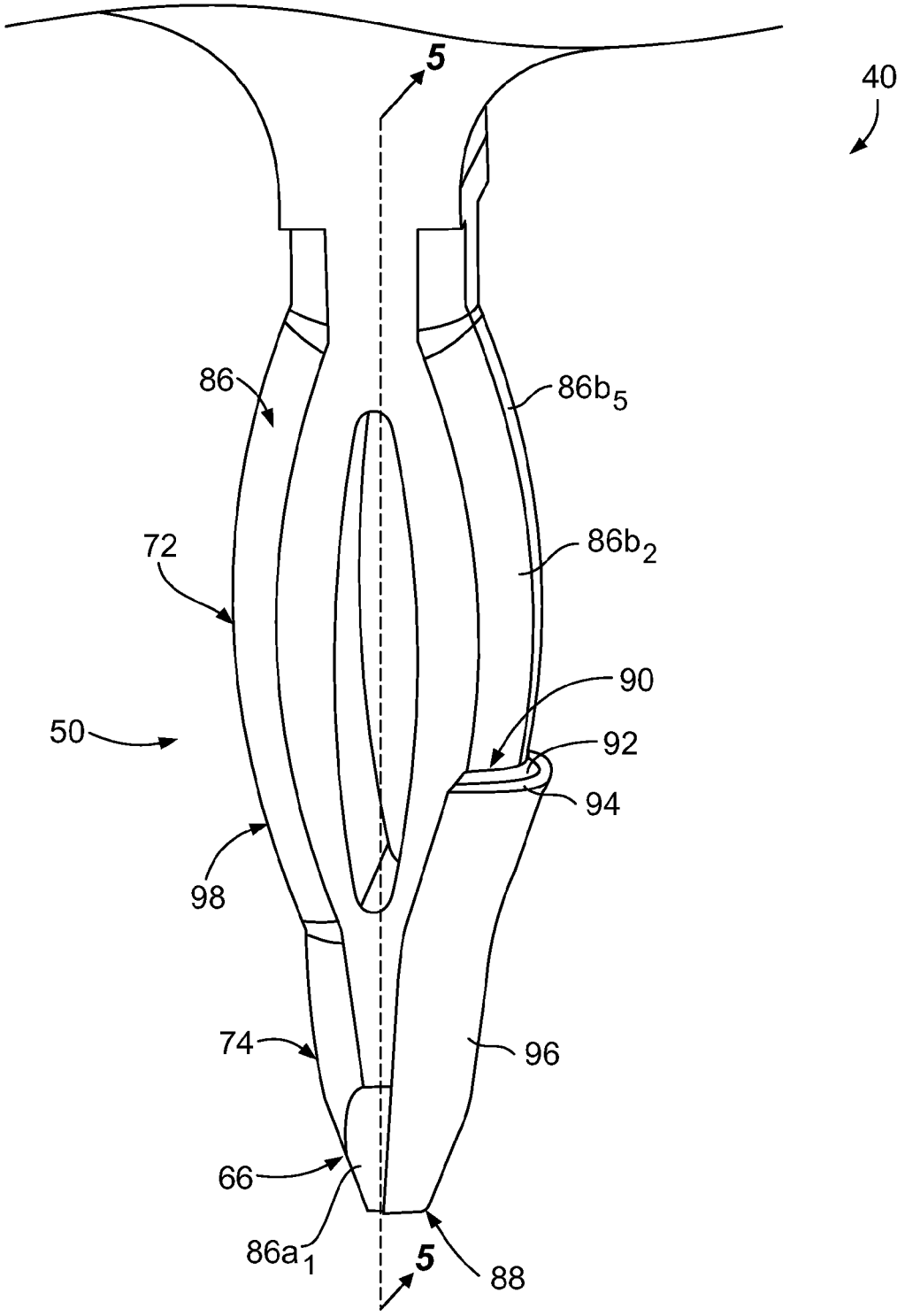
FIG. 4 is a perspective view of a portion of the electrical contact shown in FIG. 3, wherein the electrical contact includes an exemplary embodiment of a capacitor.

FIG. 4 is a perspective view of a portion of the electrical contact 40 shown in FIG. 3, wherein the electrical contact 40 includes an exemplary embodiment of a capacitor 88. FIG. 3 illustrates the mating segment 50 of the electrical contact 40 without the capacitor 88, while FIG. 4 illustrates the mating segment 50 with the capacitor 88. In the exemplary embodiment, the capacitor 88 extends on the 3D surface 86 of the mating segment 50. More specifically, the capacitor 88 extends on sub-surfaces 86$a_1$, 86$b_1$, 86$b_2$, 86$b_3$, 86$b_4$, 86$b_5$, and a sub-surface 86*b* (not visible herein) that extends between and interconnects the sub-surfaces 86$b_4$ and 86$b_5$ in a substantially similar manner to how the sub-surface 86$b_3$ extends between and interconnects the sub-surfaces 86$b_1$ and 86$b_2$. The capacitor 88 also extends on a sub-surface 86*a* that is opposite and substantially similar to the sub-surface 86$a_1$. The sub-surfaces 86$b_1$ 86$b_3$ and 86$b_4$ are not visible in FIG. 4 but can be seen in FIG. 3. In some alternative embodiments, the capacitor 88 extends entirely on a 2D surface. For example, the capacitor 88 may extend entirely on a 2D sub-surface 86*a* of the mating segment 50 in some alternative embodiments.

In the exemplary embodiment, the capacitor 88 extends on the 3D surface 86 at the compliant sub-segment 72 and at the tip sub-segment 74 of the mating segment 50. The capacitor 88 extends at the tip 66 of the mating segment 50. But, the capacitor 88 may extend on any other location(s) on the mating segment 50. Moreover, the capacitor 88 may extend on any other amount (whether more or less) of the surface area of the 3D surface 86 than is shown herein. In some embodiments, the capacitor 88 extends on an entirety of the surface area of the 3D surface 86 or extends on a majority of the surface area of the 3D surface 86.

Figure 5:
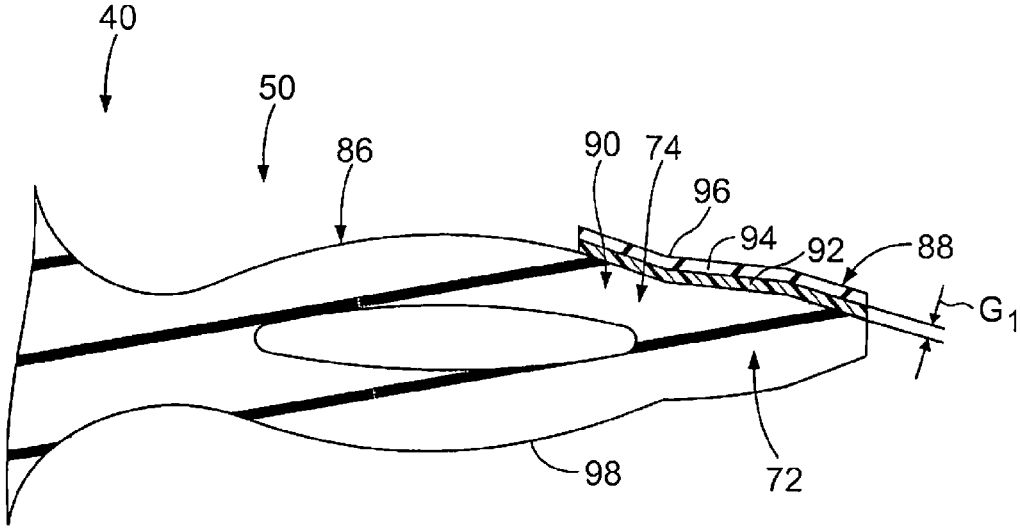
FIG. 5 is a cross-sectional view of the electrical contact shown in FIG. 4 taken along line 5-5 of FIG. 4.

FIG. 5 is a cross-sectional view taken along line 5-5 of FIG. 4. Referring now to FIGS. 4 and 5, a portion of the capacitor 88 has been broken away in FIG. 4 to illustrate the structure of the capacitor 88. The capacitor 88 includes a conductive element 90, a dielectric layer 92, and a conductive element 94. The conductive element 90 is optionally defined by the mating segment 50 of the electrical contact 40. More specifically, the conductive element 90 is optionally defined by the portions of the compliant and tip sub-segments 72 and 74, respectively, over which the remainder (e.g., the dielectric layer 92 and the conductive element 94) of the capacitor 88 extend. Accordingly, the conductive element 90 includes at least a portion of the 3D surface 86. In the exemplary embodiment, the conductive element 90 includes the sub-surfaces 86$a_1$ (as well as the opposite sub-surface 86*a* thereof), 86$b_1$, 86$b_2$, 86$b_3$, 86$b_4$, 86$b_5$, and the sub-surface 86*b* that extends between and interconnects the sub-surfaces 86$b_4$ and 86$b_5$. The sub-surfaces 86$a_1$, 86$b_1$, 86$b_2$, 86$b_3$, 86$b_4$, and 86$b_5$ are not labeled and/or visible in FIG. 5. The conductive element 90 may be referred to herein as a "first" conductive element. The conductive element 94 may be referred to herein as a "second" conductive element.

The dielectric layer 92 is formed directly on the 3D surface 86 of the conductive element 90 in engagement with the 3D surface 86. More specifically, the dielectric layer 92 is formed directly on, in engagement with, the sub-surfaces 86$a_1$ (as well as the opposite sub-surface 86*a* thereof), 86$b_1$, 86$b_2$, 86$b_3$, 86$b_4$, 86$b_5$, and the sub-surface 86*b* that extends between and interconnects the sub-surfaces 86$b_4$ and 86$b_5$. The conductive element 94 is formed on the dielectric layer 92. In the exemplary embodiment, the conductive element 94 is formed directly on the dielectric layer 92 in engagement therewith.

The dielectric layer 92 extends between the conductive elements 90 and 94 such that the dielectric layer 92 separates, or spaces apart, the conductive elements 90 and 94 by a gap $G_1$ (not labeled in FIG. 4). The dielectric layer 92 and the conductive elements 90 and 94 thereby form a capacitive structure. Various parameters of the capacitor 88 may be selected to provide the capacitor 88 with a predetermined capacitance. Examples of parameters of the capacitor 88 that may be selected to provide the predetermined capacitance include, but are not limited to, the materials used to fabricate the dielectric layer 92 and the conductive elements 90 and 94, electrical conductivity of the conductive elements 90 and 94, a dielectric constant of the dielectric layer 92, the distance between the conductive elements 90 and 94 (e.g., the amount of the gap $G_1$), the thickness of the conductive elements 90 and 94, the surface area of the conductive elements 90 and 94, an area of the amount the conductive elements 90 and 94 overlap each other, and/or the like.

Optionally, the conductive element 94 includes a mating interface 96 at which the mating segment 50 engages, and thereby establishes an electrical connection with, any electrical device, such as, but not limited to, one or more other electrical contacts (not shown; such other electrical contacts may each be referred to herein as a "mating contact"), an electrical via (not shown) of a circuit board (not shown) or other electrical device (not shown), an electrical conductor (not shown) of an electrical cable (not shown), an electrical power source (not shown), any other type of electrical device (not shown), and/or the like. In the exemplary embodiment, an outer surface of the portion of the conductive element 94 that extends over the compliant sub-segment 72 defines the mating interface 94. The mating segment 50 optionally includes another mating interface 98 that is defined by the surface 86. In some alternative embodiments, the conductive element 94 defines all of the mating interfaces of the mating segment 50. In other words, in some alternative embodiments, the only location(s) at which the mating segment 50 engages the electrical device is/are at the conductive element 94 or a substantially similar conductive element of another capacitor (not shown) formed on the mating segment 50.

Figure 6:
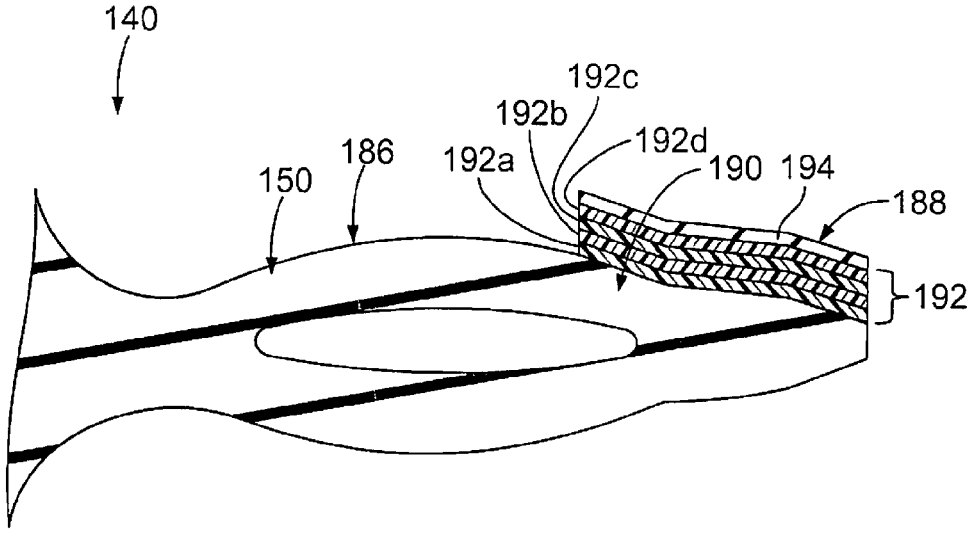
FIG. 6 is a cross-sectional view of an exemplary alternative embodiment of an electrical contact.

The dielectric layer 92 may include a single sub-layer of dielectric material, a plurality of sub-layers of completely the same dielectric material, a plurality sub-layers of different dielectric materials, or a combination of a plurality of sub-layers of completely the same dielectric material and a plurality sub-layers of different dielectric materials. In the exemplary embodiment, the dielectric layer 92 includes a single sub-layer of dielectric material. FIG. 6 is a cross-sectional view of an exemplary alternative embodiment of an electrical contact 140 having a mating segment 150 that includes a capacitor 188. The capacitor 188 includes a conductive element 190, a dielectric layer 192, and a conductive element 194. The dielectric layer 192 includes a plurality of sub-layers 192*a*, 192*b*, 192*c*, and 192*d*. Although four are shown and described herein, the dielectric layer 192 may include any number of sub-layers. The conductive element 190 may be referred to herein as a "first" conductive element. The conductive element 194 may be referred to herein as a "second" conductive element.

The conductive element 190 is defined by the mating segment 150 of the electrical contact 140 in the exemplary embodiment. Accordingly, the conductive element 190 includes at least a portion of a 3D surface 186 of the mating segment 150. The bottommost sub-layer 192*a* of the dielectric layer 192 is formed directly on the 3D surface 186 of the conductive element 190 in engagement with the 3D surface 186. The conductive element 194 is formed on the dielectric layer 192. In the exemplary embodiment, the conductive element 194 is formed directly on the uppermost sub-layer 192*d* of the dielectric layer 192 in engagement therewith. The dielectric layer 192 extends between the conductive elements 190 and 194 such that the dielectric layer 192 separates, or spaces apart, the conductive elements 190 and 194 by a gap. The dielectric layer 192 and the conductive elements 190 and 194 thereby form a capacitive structure.

In the exemplary embodiment, the plurality of sub-layers 192*a-d* of the dielectric layer 192 are of different dielectric materials. The term "different dielectric material" means that at least one of the sub-layers of the dielectric layer 192 includes at least one different dielectric material component than at least one other sub-layer of the dielectric layer 192. In some embodiments, at least one of the sub-layers of the dielectric layer 192 is fabricated from a completely different (does not share any dielectric material components) dielectric material than at least one other sub-layer of the dielectric layer 192. Moreover, in some embodiments, at least one of the sub-layers of the dielectric layer 192 is fabricated from completely the same dielectric material as at least one other sub-layer of the dielectric layer 192.

In the exemplary embodiment, the sub-layers 192*a* and 192*c* are fabricated from completely the same dielectric material, while the sub-layers 192*b* and 192*d* are fabricated from completely the same dielectric material. The dielectric material of the sub-layers 192*a* and 192*c* is completely different than the dielectric material of the sub-layers 192*b* and 192*d*. The sub-layers 192*a* and 192*c* are arranged alternatively within the dielectric layer 192 relative to the sub-layers 192*b* and 192*d*, in the exemplary embodiment. Accordingly, the dielectric layer 192 includes alternating sub-layers of different dielectric materials. But, the sub-layers 192*a-d* of the dielectric layer 192 may have any other relative arrangement within the dielectric layer 192, including arrangements wherein two sub-layers of completely the same dielectric material are arranged directly adjacent each other in engagement with each other.

In some alternative embodiments, the dielectric material of the sub-layers 192*a* and 192*c* is only partially different (shares at least one dielectric material component) from the dielectric material of the sub-layers 192*b* and 192*d*. Moreover, in some alternative embodiments, each of the sub-layers of the dielectric layer 192 is a different dielectric material than each other sub-layer of the dielectric layer 192. Each of the sub-layers 192*a-d* may be referred to herein as a "first" sub-layer and/or a "second" sub-layer.

Figure 7:
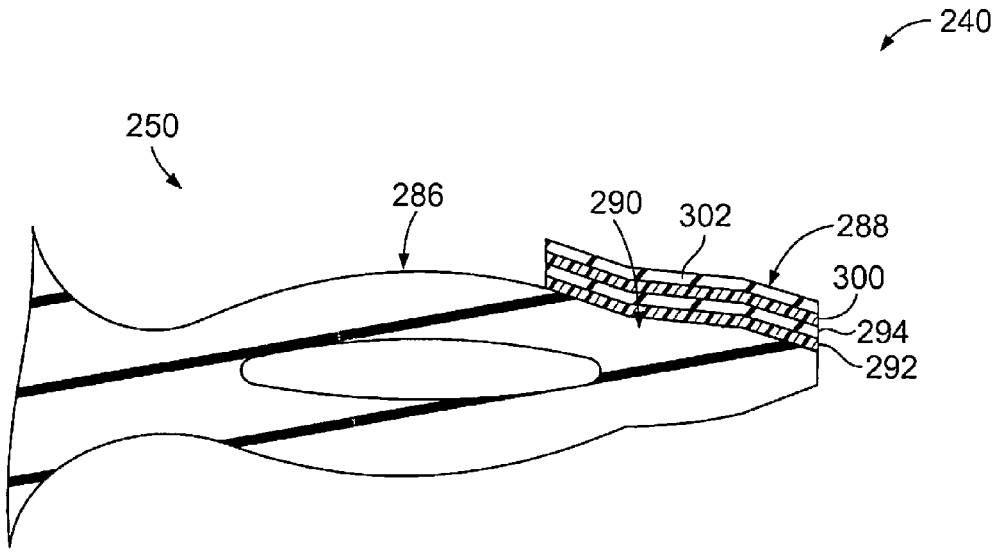
FIG. 7 is a cross-sectional view of another exemplary alternative embodiment of an electrical contact.

FIG. 7 is a cross-sectional view of another exemplary alternative embodiment of an electrical contact 240 having a mating segment 250 that includes a capacitor 288. The capacitor 288 includes a conductive element 290, a dielectric layer 292, a conductive element 294, a dielectric layer 300, and a conductive element 302. In the exemplary embodiment, the conductive element 290 is defined by the mating segment 250 of the electrical contact 240. Accordingly, the conductive element 290 includes at least a portion of a 3D surface 286 of the mating segment 250.

The dielectric layer 292 is formed directly on the 3D surface 286 of the conductive element 290 in engagement with the 3D surface 186. The conductive element 294 is formed on the dielectric layer 292. In the exemplary embodiment, the conductive element 294 is formed directly on the dielectric layer 292 in engagement therewith. The dielectric layer 292 extends between the conductive elements 290 and 294 such that the dielectric layer 292 and the conductive elements 290 and 294 form a capacitive structure. The dielectric layer 300 is formed directly on the conductive element 294 in engagement therewith. The conductive element 302 is formed on the dielectric layer 300. In the exemplary embodiment, the conductive element 302 is formed directly on the dielectric layer 300 in engagement therewith. The dielectric layer 300 extends between the conductive elements 294 and 302 such that the dielectric layer 300 and the conductive elements 294 and 302 form a capacitive structure.

Each of the dielectric layers 292 and 300 may include a single sub-layer of dielectric material, a plurality of sub-layers of completely the same dielectric material, or a plurality sub-layers of different dielectric materials. The conductive elements 290, 294, and 302 may be referred to herein as a "first", a "second", and a "third" conductive element, respectively. The dielectric layers 292 and 300 may be referred to herein as "first" and "second" dielectric layers, respectively.

Figure 8:
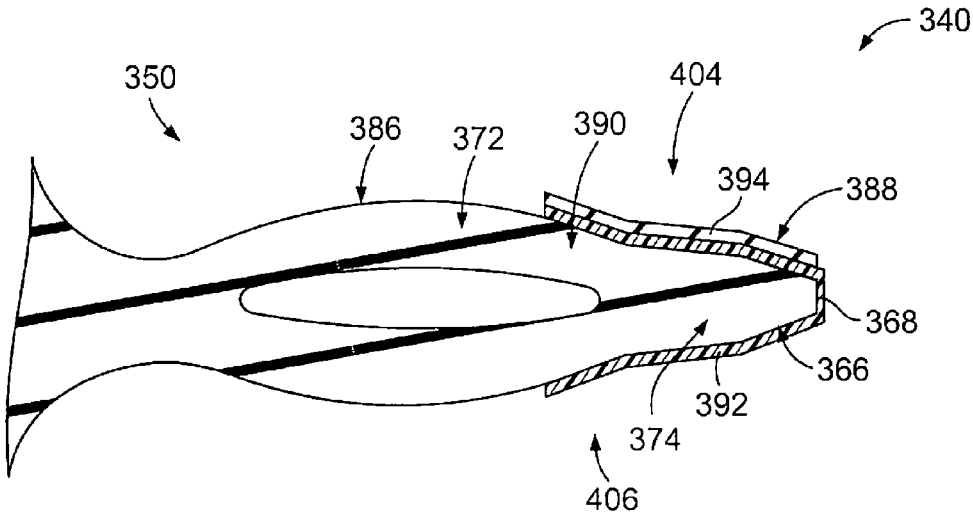
FIG. 8 is a cross-sectional view of another exemplary alternative embodiment of an electrical contact.

FIG. 8 is a cross-sectional view of another exemplary alternative embodiment of an electrical contact 340 having a mating segment 350 that includes a capacitor 388. The capacitor 388 includes a conductive element 390, a dielectric layer 392, and a conductive element 394. In the exemplary embodiment, the conductive element 390 is defined by the mating segment 350 of the electrical contact 340. Accordingly, the conductive element 390 includes at least a portion of a 3D surface 386 of the mating segment 350.

The dielectric layer 392 is formed directly on the 3D surface 386 of the conductive element 390 in engagement with the 3D surface 386. The conductive element 394 is formed on the dielectric layer 392. In the exemplary embodiment, the conductive element 394 is formed directly on the dielectric layer 392 in engagement therewith. The dielectric layer 392 extends between the conductive elements 390 and 394 such that the dielectric layer 392 and the conductive elements 390 and 394 form a capacitive structure. The dielectric layer 392 may include a single sub-layer of dielectric material, a plurality of sub-layers of completely the same dielectric material, or a plurality sub-layers of different dielectric materials. The conductive elements 390 and 394 may be referred to herein as a "first" and a "second" conductive element, respectively.

The capacitor 388 extends on the 3D surface 386 at a compliant sub-segment 372 and at a tip sub-segment 374 of the mating segment 350. The tip sub-segment 374 includes a tip 366 having a tip surface 368. The capacitor 388 extends at the tip 366 of the mating segment 350. The dielectric layer 392 extends over the tip surface 368 and over opposite sides 404 and 406 of the mating segment 350, while the conductive element 394 extends over only the side 404.

Figure 9:
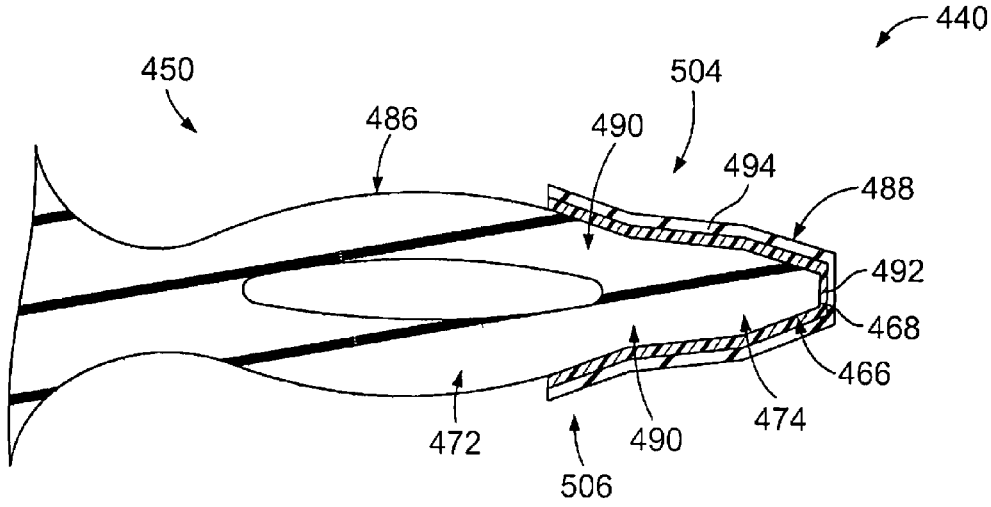
FIG. 9 is a cross-sectional view of another exemplary alternative embodiment of an electrical contact.

FIG. 9 is a cross-sectional view of another exemplary alternative embodiment of an electrical contact 440 having a mating segment 450 that includes a capacitor 488. The capacitor 488 includes a conductive element 490, a dielectric layer 492, and a conductive element 494. The conductive element 490 is defined by the mating segment 450 of the electrical contact 418, in the exemplary embodiment, such that the conductive element 490 includes at least a portion of a 3D surface 486 of the mating segment 450. The dielectric layer 492 is formed directly on the 3D surface 486 of the conductive element 490 in engagement with the 3D surface 486. The conductive element 494 is formed directly on the dielectric layer 492 in engagement therewith. The dielectric layer 492 extends between the conductive elements 490 and 494 such that the dielectric layer 492 and the conductive elements 490 and 494 form a capacitive structure. The dielectric layer 492 may include a single sub-layer of dielectric material, a plurality of sub-layers of completely the same dielectric material, or a plurality sub-layers of different dielectric materials. The conductive elements 490 and 494 may be referred to herein as a "first" and a "second" conductive element, respectively.

The capacitor 488 extends on the 3D surface 486 at a compliant sub-segment 472 and at a tip sub-segment 474 of the mating segment 450. The tip sub-segment 474 includes a tip 466 having a tip surface 468. The capacitor 488 extends at the tip 466 of the mating segment 450. The conductive element 490 includes the tip surface 468. Both the dielectric layer 492 and the conductive element 494 extend over the tip surface 468 and over opposite sides 504 and 506 of the mating segment 450. Accordingly, the capacitor 488 extends over the tip surface 468 and over opposite sides 504 and 506 of the mating segment 450.

Figure 10:
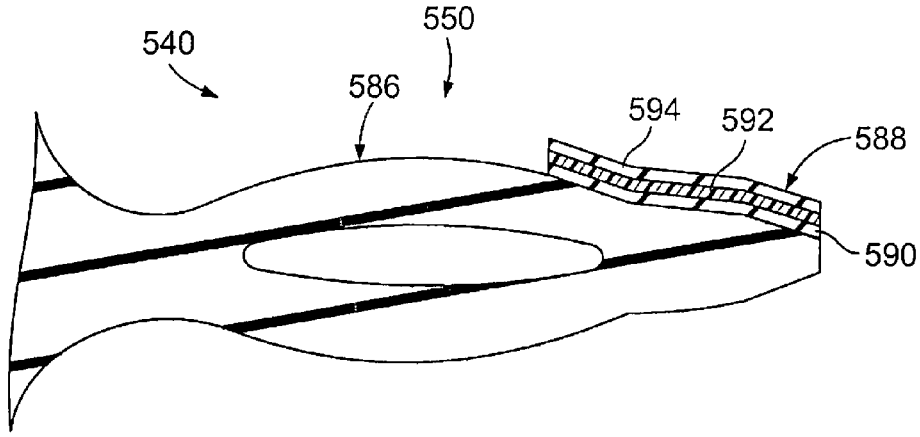
FIG. 10 is a cross-sectional view of yet another exemplary alternative embodiment of an electrical contact.

FIG. 10 is a cross-sectional view of yet another exemplary alternative embodiment of an electrical contact 540, which includes a mating segment 550 that includes a capacitor 588. The mating segment 550 includes a 3D surface 586. The capacitor 588 includes a conductive element 590, a dielectric layer 592, and a conductive element 594. In contrast to at least some other embodiments described and/or illustrated herein, the conductive element 590 is not defined by the mating segment 550 of the electrical contact 540. Rather, the conductive element 590 is a discrete conductive layer that extends on the 3D surface 586. More specifically, the conductive element 590 is formed directly on the 3D surface 586 of the mating segment 550 in engagement with the 3D surface 586. The dielectric layer 592 is formed directly on the conductive element 590 in engagement therewith. The conductive element 594 is formed directly on the dielectric layer 592 in engagement therewith. The dielectric layer 592 extends between the conductive elements 590 and 594 such that the dielectric layer 592 and the conductive elements 590 and 594 form a capacitive structure. The dielectric layer 592 may include a single sub-layer of dielectric material, a plurality of sub-layers of completely the same dielectric material, or a plurality sub-layers of different dielectric materials. The conductive elements 590 and 594 may be referred to herein as a "first" and a "second" conductive element, respectively.

Figure 11:
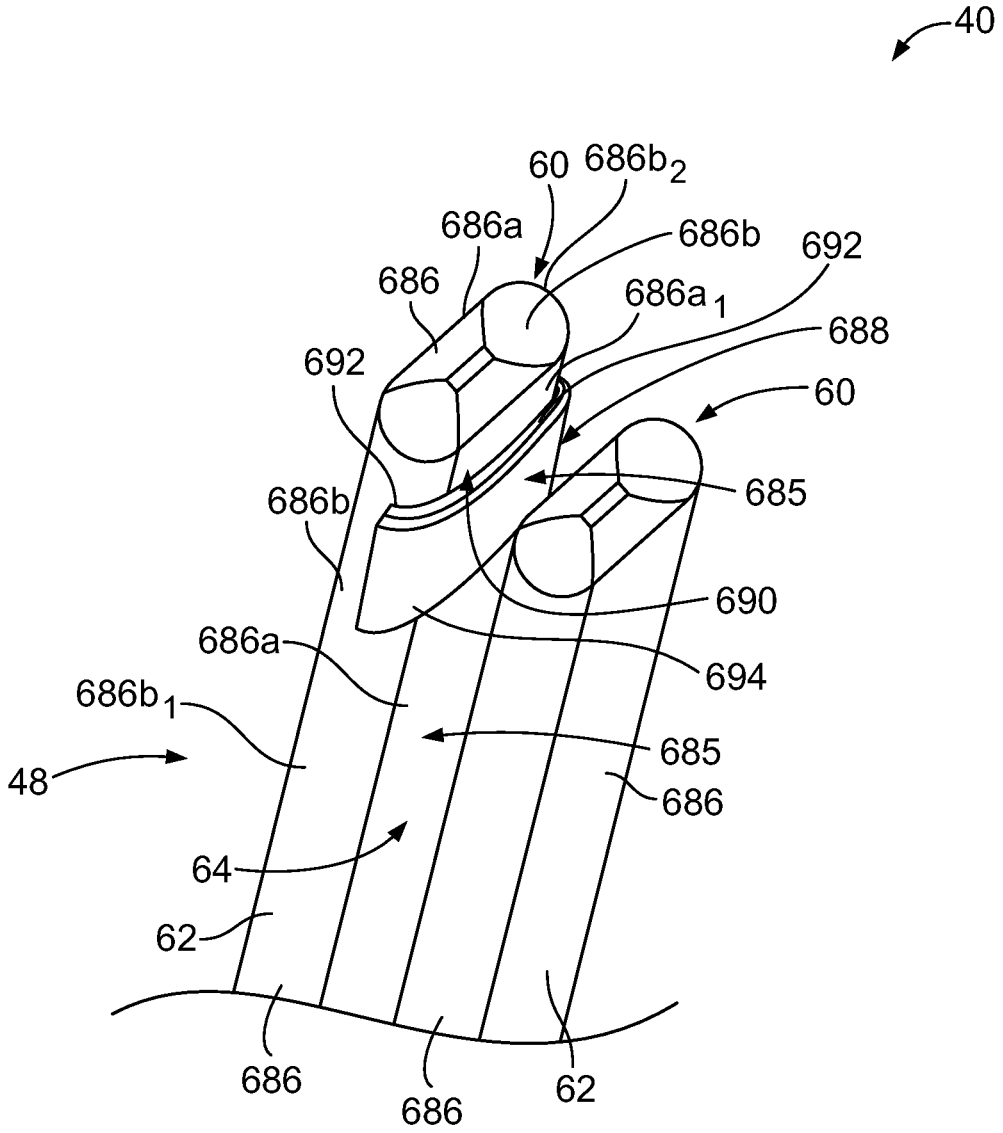
FIG. 11 is a perspective view of a portion of the electrical contact shown in FIG. 3 illustrating an exemplary embodiment of another mating segment of the electrical contact.

Referring again to FIG. 4, the capacitor 88 is not limited to extending on the mating segment 50 of the electrical contact 40. Rather, in addition or alternatively, the mating segment 48 may include a capacitor. FIG. 11 is a perspective view of a portion of one of the electrical contacts 40 illustrating an exemplary embodiment of the mating segment 48 of the electrical contact 40, wherein the mating segment 48 includes a capacitor 688. The mating segment 48 extends outwardly to an end 60 and includes a pair of resiliently deflectable spring arms 62. The arms 62 are spaced apart to define a mating slot 64 therebetween. The mating slot 64 defines a mating interface 685 at which the mating segment 48 engages any electrical device, such as, but not limited to, one or more other electrical contacts (not shown; such other electrical contacts may each be referred to herein as a "mating contact"), an electrical via (not shown) of a circuit board (not shown) or other electrical device (not shown), an electrical conductor (not shown) of an electrical cable (not shown), an electrical power source (not shown), any other type of electrical device (not shown), and/or the like.

As can be seen in FIG. 11, the mating segment 48 includes a 3D surface 686. The 3D surface 686 is non-planar. The 3D surface 686 of the mating segment 48 includes a plurality of 2D sub-surfaces 686*a* and a plurality of 3D sub-surfaces 686*b*. Only some of the sub-surfaces 686*a* and 686*b* are visible in FIG. 11. Moreover, only some of the visible surface 686 and only some of the visible sub-surfaces 686*a* and 686*b* may be labeled in FIG. 11.

The capacitor 688 extends on the 3D surface 686 of the mating segment 48. More specifically, the capacitor 688 extends on sub-surfaces $\mathbf{686}a_1$, $\mathbf{686}b_1$, and $\mathbf{686}b_2$. In some alternative embodiments, the capacitor 688 extends entirely on a 2D surface. For example, the capacitor 688 may extend entirely on a 2D sub-surface 686*a* of the mating segment 48 in some alternative embodiments. In the exemplary embodiment, the capacitor 688 extends on the 3D surface 686 at the end 60 of the mating segment 48. But, the capacitor 688 may extend on any other location(s) on the mating segment 48. Moreover, the capacitor 688 may extend on any other amount (whether more or less) of the surface area of the 3D surface 686 than is shown herein. In some embodiments, the capacitor 688 extends on an entirety of the surface area of the 3D surface 686 or extends on a majority of the surface area of the 3D surface 686.

The capacitor 688 includes a conductive element 690, a dielectric layer 692, and a conductive element 694. The conductive element 690 is optionally defined by the mating segment 48 of the electrical contact 40. In the exemplary embodiment, the conductive element 690 is defined by the mating segment 48 and includes at least a portion of the 3D surface 686. More specifically, the conductive element 690 includes the sub-surfaces $\mathbf{686}a_1$, $\mathbf{686}b_1$, and $\mathbf{686}b_2$. The conductive element 690 may be referred to herein as a "first" conductive element. The conductive element 694 may be referred to herein as a "second" conductive element.

The dielectric layer 692 is formed directly on the 3D surface 686 of the conductive element 690 in engagement with the 3D surface 686. More specifically, the dielectric layer 692 is formed directly on, in engagement with, the sub-surfaces $\mathbf{686}a_1$, $\mathbf{686}b_1$, and $\mathbf{686}b_2$. The conductive element 694 is formed directly on the dielectric layer 692 in engagement therewith. The dielectric layer 692 extends between the conductive elements 690 and 694 such that the dielectric layer 692 and the conductive elements 690 and 694 form a capacitive structure.

The conductive elements and the dielectric layers of the capacitors described and/or illustrated herein may be fabricated from any materials. Exemplary materials for the conductive elements described and/or illustrated herein include, but are not limited to, nickel, gold, copper, and/or the like. Exemplary materials for the dielectric layers described and/or illustrated herein include, but are not limited to, barium titanate ($BaTiO_3$), hafnium oxide or hafnium dioxide ($HfO_2$), alumina or aluminum oxide ($Al_2O_3$), metal oxides, a mica material, micalex, hafnium silicate ($HISiO_4$), barium titanate niobate ($Ba_6Ti_2Nb_8O_{30}$), lead hafnate ($PbHfO_3$), lead magnesium niobate ($Pb_3MgNb_2O_9$), lead metatantalate ($PbTa_2O_6$), lead sulfide ($PbS$), lead titanate ($PbTiO_3$), lead zirconate ($PbZrO_3$), nitrided hafnium silicate ($HfSiON$), tantalum oxide ($Ta_2O_5$), zirconium dioxide ($ZrO_2$), titanium dioxide ($TiO_2$), strontium titanate ($SrTiO_3$), tungsten trioxide ($WO_3$), zirconium silicate ($ZrSiO_4$), and/or calcium titanate ($CaTiO_3$), boron nitride ($BN$), magnesium carbonate ($MgCO_3$), diamond, and/or the like.

The capacitors described and/or illustrated herein may be fabricated using any method, process, structure, means, and/or the like. More specifically, the dielectric layers and conductive elements described and/or illustrated herein may be fabricated using any method, process, structure, means, and/or the like. Examples of suitable processes for forming the dielectric layers and the conductive elements described and/or illustrated herein on 2D and 3D surfaces include, but are not limited to, chemical solution deposition (CSD), chemical vapor deposition (CVD), physical vapor deposition (PVD), atomic layer deposition (ALD), electrodeposition, electrocoating, electroplating, screen printing, dip coating, aerosol coating, spin coating, sputtering, and/or the like. Forming the dielectric layers and/or the conductive elements described and/or illustrated herein may include heat treating and/or otherwise processing the dielectric layers, the conductive elements, and/or sub-layers thereof.

As described above, the dielectric layers described and/or illustrated herein may include a single sub-layer of dielectric material, a plurality of sub-layers of completely the same dielectric material, or a plurality sub-layers of different dielectric materials. The dielectric layers described and/or illustrated herein may be formed using a single pass or using multiple passes. In other words, the entire thickness of a dielectric layer may be formed at the same time in a single pass, or individual sub-thicknesses of the dielectric layers may be formed in sequence using multiple passes. A dielectric layer that is formed from multiple passes of completely the same material may include a single sub-layer of dielectric material or a plurality of sub-layers of completely the same dielectric material. Whether a dielectric layer that is formed from multiple passes of completely the same material includes a single sub-layer of dielectric material or a plurality of sub-layers of completely the same dielectric material may depend on how the dielectric layer is processed. For example, if the individual sub-thicknesses (formed from each pass) are heat treated before the next sub-thickness is formed thereon, the dielectric layer may include a plurality of sub-layers of completely the same dielectric material. It should be understood that when a dielectric layer includes a plurality of sub-layers (whether of completely the same or of different dielectric materials), each sub-layer may be formed using any number of passes.

Forming a dielectric layer that includes a plurality of sub-layers (whether of completely the same or of different dielectric materials) may facilitate providing a dielectric layer that has a reduced thickness but has the same or a reduced porosity. Moreover, when a dielectric layer includes a plurality of sub-layers (whether of completely the same or of different dielectric materials), the sub-layers may be heat treated and/or otherwise processed, for example to evaporate organic materials therefrom before the next sub-layer is formed thereon. Evaporating the organic materials from such sub-layers may facilitate preventing the dielectric layer from cracking during a heat treatment of the entire dielectric layer.

The electrical contacts 10, 40, 140, 240, 340, 440, and 540 shown and/or described herein are meant as exemplary only. The capacitors shown and/or described herein may be formed on and/or partially defined by any other type of electrical contact having any other geometry, configuration, structure, and/or the like than the electrical contacts 10, 40, 140, 240, 340, 440, and 540. For example, in addition or alternatively to the EON pins, the mating segments 50, 150, 250, 250, 450, and 550 may include any other structure, such as, but not limited to, a solder pin, another type of press-fit pin, a spring pin, a surface mount configuration, and/or the like. Moreover, and for example, in addition or alternatively to the spring arms 62 of the mating segment 48, the mating segments 48 of the electrical contacts 40 may include any other structure, such as, but not limited to, a pin, a plug, a receptacle, and/or the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising:

a body having a mating segment, the mating segment of the body comprising opposite first and second sides and a tip having a tip surface, at least a portion of the mating segment defining a first conductive element having a three-dimensional (3D) surface;

a dielectric layer formed directly on the 3D surface of the first conductive element in engagement with the 3D surface; and a second conductive element formed on the dielectric layer such that the dielectric layer extends between the first and second conductive elements, the first and second conductive elements and the dielectric layer forming a capacitor, wherein at least one of the dielectric layer or the second conductive element extends over the mating segment from the first side of the mating segment, over the tip surface, to the second side of the mating segment.

2. The electrical contact of claim 1, wherein the dielectric layer comprises one of alternating sub-layers of different dielectric materials or a plurality of sub-layers of the same dielectric material.

3. The electrical contact of claim 1, wherein the dielectric layer comprises at least two sub-layers, a first sub-layer of the at least two sub-layers comprising a dielectric material that is different than a dielectric material of a second sub-layer of the at least two sub-layers.

4. The electrical contact of claim 1, wherein the 3D surface is non-planar.

5. The electrical contact of claim 1, wherein the dielectric layer is a first dielectric layer, the electrical contact further comprising a second dielectric layer and a third conductive element, the second dielectric layer extending between the second and third conductive elements.

6. The electrical contact according to claim 1, wherein the second conductive element comprises a mating interface that is configured to at least one of engage at least one mating contact, engage an electrical device, or engage a circuit board.

7. The electrical contact according to claim 1, wherein the mating segment of the body comprises one of a pin, a plug, a receptacle, a spring arm, a press-fit pin, a spring pin, or a solder pin.

8. The electrical contact of claim 1, wherein the dielectric layer is formed on the first conductive element at or proximate the tip of the mating segment.

9. The electrical contact of claim 1, wherein the first conductive element has a thickness that is at least twice as thick as a thickness of the second conductive element.

10. A capacitor comprising:

a first conductive element;

a second conductive element; and a dielectric layer extending between the first and second conductive elements, the dielectric layer comprising first and second sub-layers, the first sub-layer comprising a different dielectric material than the second sub-layer, wherein the first sub-layer comprises a plurality of first sub-layers and the second sub-layer comprises a plurality of second sub-layers, the first and second sub-layers being arranged alternatingly within the dielectric layer.

11. The capacitor of claim 10, wherein the dielectric layer is a first dielectric layer, the capacitor further comprising a second dielectric layer and a third conductive element, the second dielectric layer extending between the second and third conductive elements.

12. The capacitor of claim 10, wherein the first conductive element comprises a three-dimensional (3D) surface, the dielectric layer being formed directly on the 3D surface of the first conductive element in engagement with the 3D surface.

13. The capacitor of claim 10, wherein the first conductive element is defined by a mating segment of an electrical contact.

* * * * *